US006715604B2

(12) United States Patent
Taylor

(10) Patent No.: US 6,715,604 B2
(45) Date of Patent: Apr. 6, 2004

(54) LIQUID CONTAINER WITH LIQUID ABSORBENT BASE

(75) Inventor: Paul Taylor, Alberta (CA)

(73) Assignee: IPX Corporation, Edmonton (CA)

( * ) Notice: Subject to any disclaimer, the term of this patent is extended or adjusted under 35 U.S.C. 154(b) by 0 days.

(21) Appl. No.: 09/895,841

(22) Filed: Jun. 28, 2001

(65) Prior Publication Data

US 2002/0013992 A1 Feb. 7, 2002

(30) Foreign Application Priority Data

Jun. 29, 2000 (CA) ..... 2312280

(51) Int. Cl.[7] ..... B65D 81/26

(52) U.S. Cl. ..... 206/204; 215/394; 220/729; 248/346.11

(58) Field of Search ..... 206/204, 460, 206/813; 215/388, 389, 392, 393, 394; 220/705, 729; 248/346.11, 346.2

(56) References Cited

U.S. PATENT DOCUMENTS

| | | | | | |
|---|---|---|---|---|---|
| 1,862,533 | A | * | 6/1932 | Fish | 215/394 |
| 2,570,954 | A | * | 10/1951 | Kasman | 215/394 |
| 3,847,324 | A | * | 11/1974 | Uchanski et al. | 248/346.11 |
| 4,040,549 | A | * | 8/1977 | Sadler | 215/398 |
| 4,759,525 | A | * | 7/1988 | Cross et al. | 248/346.11 |
| 4,765,465 | A | * | 8/1988 | Yamada et al. | 215/393 |
| 5,201,460 | A | * | 4/1993 | Caines | 220/705 |
| 5,273,182 | A | * | 12/1993 | Laybourne | 215/394 |
| 5,938,162 | A | * | 8/1999 | Honjo | 248/346.11 |

* cited by examiner

*Primary Examiner*—Luan K. Bui
(74) *Attorney, Agent, or Firm*—Townsend and Townsend and Crew LLP

(57) ABSTRACT

A liquid absorbent base for a liquid beverage container used in the Food and Beverage Industry. A liquid absorbent wafer is provided that is secured onto the base of the container. The liquid-absorbent base and beverage container are used in combination as a liquid-absorbent substrate for cleaning up spillage and liquid condensate.

23 Claims, 4 Drawing Sheets

LIQUID CONTAINER WITH LIQUID ABSORBENT BASE

BACKGROUND OF THE INVENTION

The present invention relates to cups and other liquid containers, and in particular, to a liquid-absorbent base for a cup or container for use in absorbing liquid condensate and cleaning up spillage.

"In Canadian Patent Application No. 2,309,621, filed Jun. 29, 2000, (hereinafter, "the '621 Application"), and corresponding U.S. patent application Ser. No. 09/896,180, filed concurrently herewith on Jun. 28, 2001, abandoned the contents of which are each hereby incorporated by reference in its entirety for all purposes, a cup-holder invention is described which is useful to reduce paper waste associated with using napkins to clean-up spillage from disposable cups used in the Food and Beverage Industry. Referring to the '621 Application, a cup and liquid-absorbent cup-holder is provided in combination. The cup-holder may be removed from the cup and used as a liquid-absorbent substrate for cleaning up spillage and liquid condensate."

It is desirable to provide a cup having a portion that is liquid-abosorbent.

SUMMARY OF THE INVENTION

The present invention provides a container device for cleaning up spillage, liquid condensate and the like used in association with both heated and unheated beverages, and which includes a liquid-absorbent portion, or a removable portion of the cup, for cleaning up spillage.

According to an aspect of the present invention, a liquid-absorbent portion for a container used for holding a liquid is provided. Typically, the beverage container includes:

a base;

an upstanding vertical sidewall attached to the base, which container is divided by the base into an inner portion forming a liquid containing vessel and an outer portion;

a recess formed on the outer portion having a recess thickness and recess dimension; and a liquid-absorbent wafer;

wherein the liquid-absorbent wafer has a prescribed wafer shape and wafer thickness to allow it to fit into the recess such that when the wafer is securely fastened into the recess the wafer is contiguous with the surface that the container sits on.

According to another aspect of the invention, a method is provided for producing a beverage container for holding liquid which is comprised of a liquid-absorbent portion. Typically, the method includes:

providing a wafer having a top portion, a bottom portion, a wafer thickness and a wafer dimension; and securing the wafer onto the outer portion of the container to form a cupkin.

As used herein, the term "cupkin" is used to describe an aspect of the present invention relating to a cup and wafer napkin in combination. The remaining disclosure describes embodiments of the wafer and the cupkin in accordance of the present invention.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

DETAILED DESCRIPTION

Figure 1:
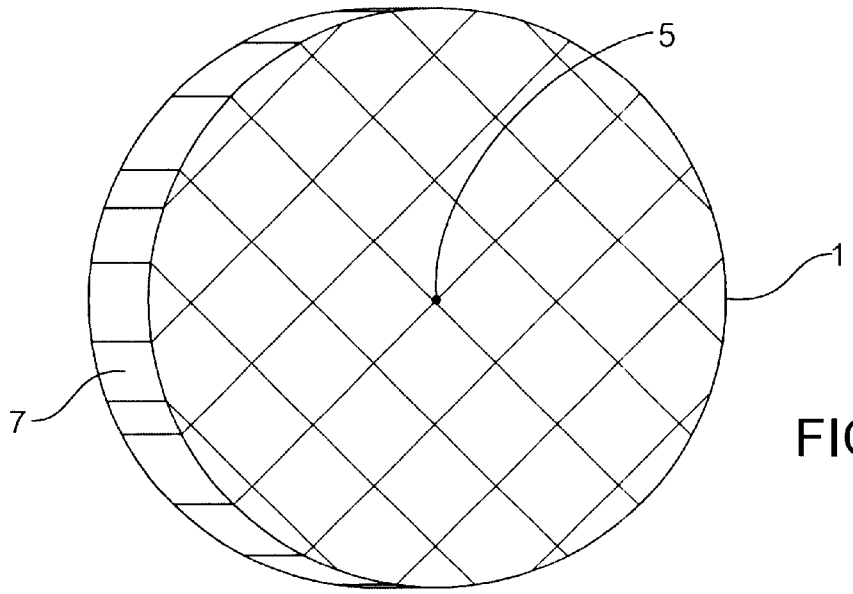
FIG. 1 illustrates a wafer having a wafer dimension and a wafer thickness.
Figure 2:
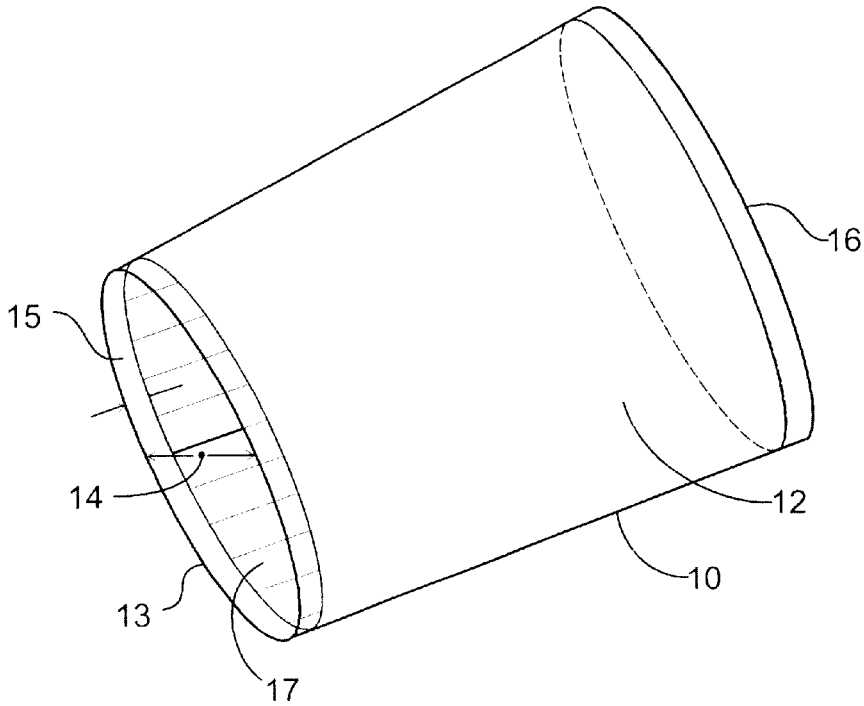
FIG. 2 is an underside view of a cup showing a recess dimension and a recess thickness.

Referring to FIG. 1, according to an embodiment of the present invention, a liquid-absorbent wafer 1 is shown having a wafer dimension 5, e.g., diameter, and a wafer thickness 7. As shown in FIG. 2, a cup 10 is provided for carrying the wafer 1. The cup 10 is comprised of a base 11 and an upstanding sidewall 12. The cup 10 is divided by the base 11 into an inner portion 16 forming a liquid-containing vessel, e.g., for a liquid beverage contained therein, and an outer portion 17 forming a recess 13. The recess 13 is formed on the outer portion 17 between the base 11 and the upstanding sidewall 12. The recess 13 has a suitable recess dimension 14 and recess thickness 15 to accommodate the wafer 1 having wafer dimension 5 and wafer thickness 6.

According to one embodiment of the present invention, at least a portion of wafer 1, and preferably the entire wafer 1, is made from any suitable liquid-absorbent material. Preferably, the material should be inexpensive to manufacture and easy to form into the desired wafer dimension and wafer thickness. A liquid-absorbent fibrous paper product commonly used to produce napkins used to clean up spillage in the Food and Beverage Industry, or a liquid absorbent sponge material are two examples of a suitable liquid-absorbent material. However, any suitable liquid-absorbent material that may be formed into a wafer 1 may be used.

Figure 3:
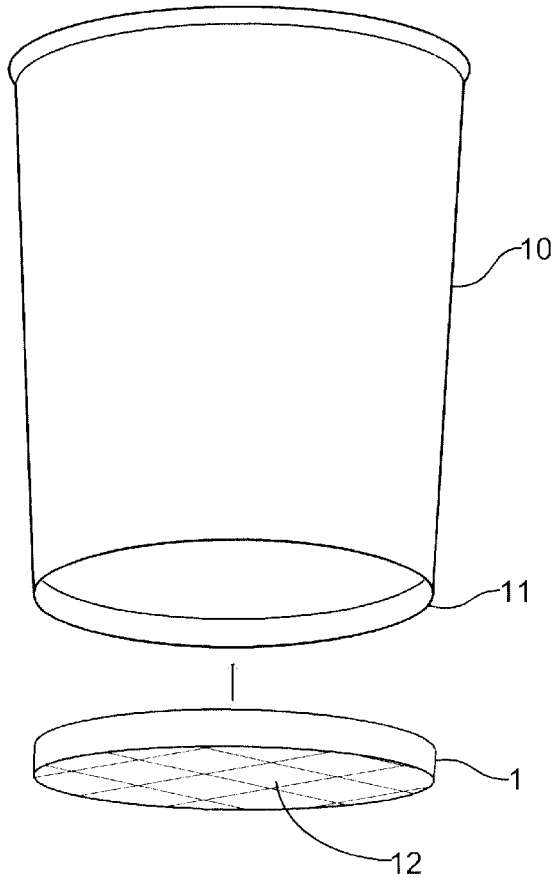
FIG. 3 is an exploded view showing the cup and wafer.
Figure 4:
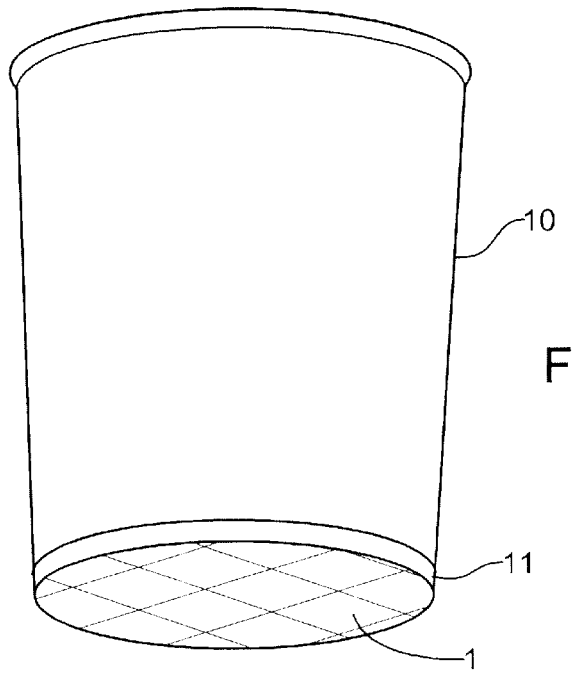
FIG. 4 illustrates the wafer secured into the recess of the cup to form a "cupkin"

Referring to FIGS. 3 and 4, the wafer 1 has a wafer dimension 5 that is less than the recess dimension 14 of the cup such that the wafer 1 fits into the underside 12 of the cup 10. Preferably, however, the wafer dimension 5 is approximately equal to the recess dimension 14 to maximize the surface area available for absorption of liquid.

Figure 5:
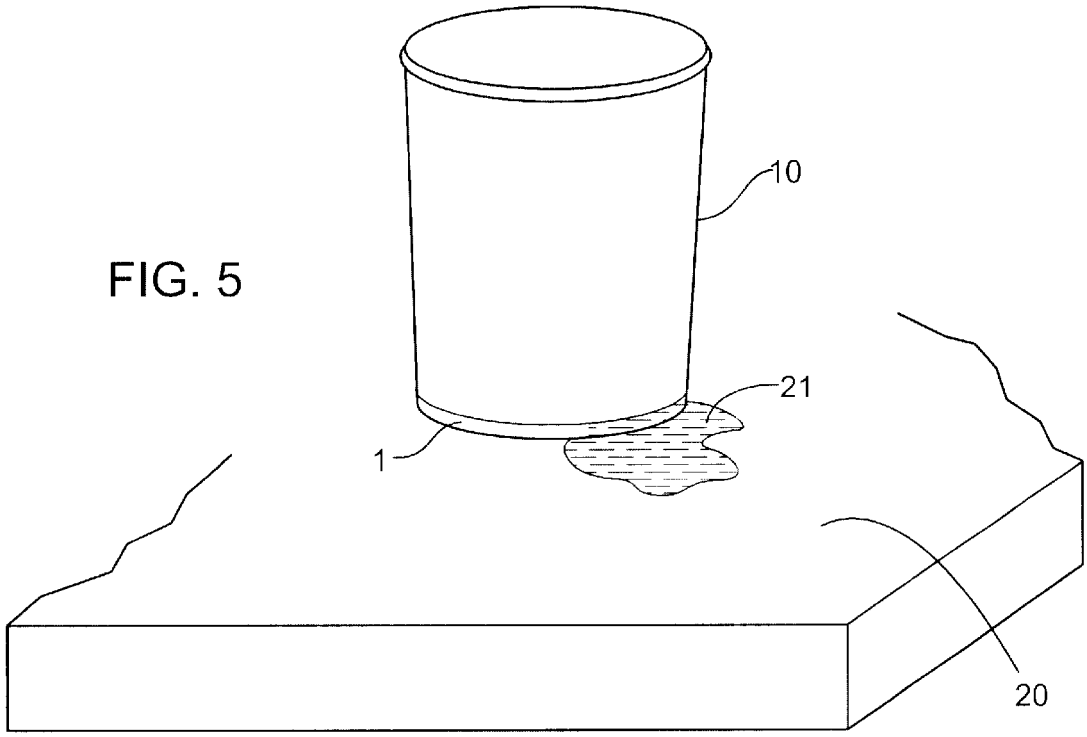
FIG. 5 shows the cup and the wafer in combination on a surface having a spillage.

Referring to FIG. 5, the wafer 1 has a wafer thickness 7 that is sufficient to be contiguous with spillage 21 on the surface 20 when the wafer 1 is secured within the recess 13 in accordance with the present invention. Any wafer thickness 7 that will permit the cup 10 to remain in a substantially upright position when placed on the surface 20 may be used. Preferably, however, the wafer thickness 7 is greater than or equal to the recess thickness 15 such that the cup 10 rests on a bottom portion 9 of the wafer 1.

Figure 6:
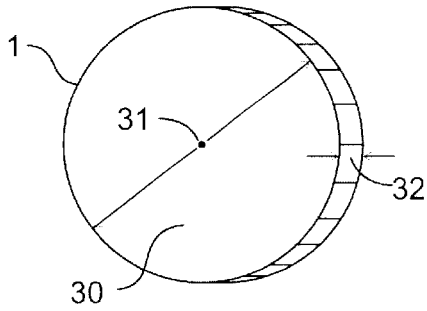
FIG. 6 illustrates a wafer shaped as a substantially circular disk.
Figure 7:
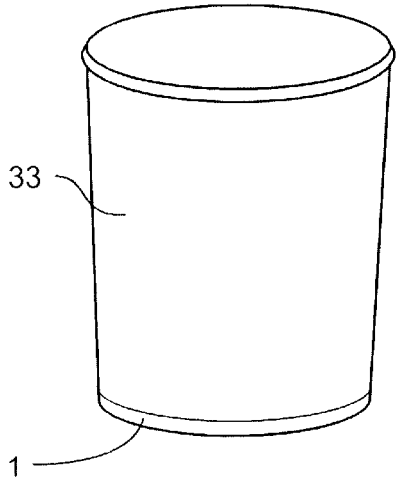
FIG. 7 illustrates the circular disk wafer in combination with a cylindrical beverage container.

Referring to FIGS. 6 and 7, according to one embodiment, the wafer 1 is shaped as a circular disk 30 of diameter 31 and thickness 32. The wafer 1 is intended to be secured into a recess 13 of a cylindrical cup 33. One example of such a cylindrical cup 33 is a common cup used in the Tea and Coffee Industry for serving heated beverages. However, the circular disk 30 and cylindrical cup 33 may be used in combination for unheated beverages.

Figure 8:
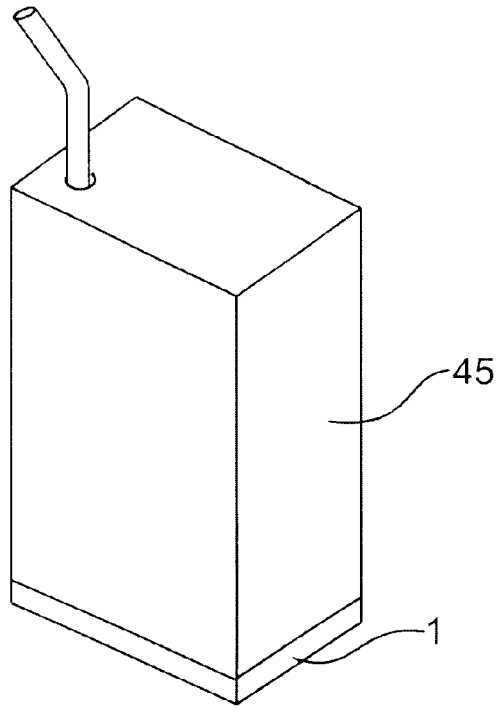
FIG. 8 illustrates a wafer having a rectangular shape.
Figure 9:
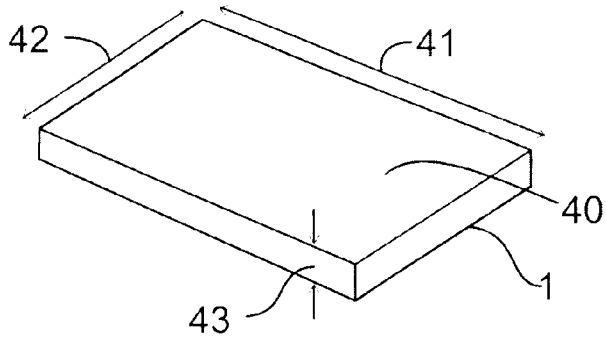
FIG. 9 illustrates a rectangular wafer in combination with a rectangular container.

Referring to FIGS. 8 and 9, according to an embodiment of the present invention, the wafer 1 is shaped as a rectangular wafer 40 having a length 41, width 42, and thickness 43. The wafer 40 is intended to be fixedly secured to the bottom of the beverage container having a rectangular cross-sectional area 45. One example of such a rectangular beverage container 45 for use with the rectangular wafer 40 is marketed under the name TETRA PAK™.

Generally, a liquid-absorbent wafer according to the present invention having sufficient dimension may be implemented with any type of beverage container having either a closed or open topped portion, such as a "juice box" or open carton, for example. Also, the cup 10 and wafer 1 may be formed in an integral one-piece design, or the base 11 and the wafer 1 may be integral, or any combination thereof. What is important is that the cup, and preferably the base of the cup, is provided with a liquid-absorbent portion.

The wafer 1 may be fixedly secured into the recess 13 in any manner that holds the wafer 1 onto the base of the cup 10. Preferably, however, the wafer is glued within the recess 13 using adhesive glue. This method of fixedly securing the wafer 1 to the base of the container is particularly relevant when using the rectangular container 45, wherein no recess 13 is usually present for supporting the wafer 1.

According to one embodiment, a process of manufacturing a beverage container having a liquid absorbent portion for cleaning up liquid spillage generally includes: providing a wafer having a top portion, a bottom portion, a wafer dimension, and a wafer thickness; and securing the wafer onto the outer portion of the container.

In one embodiment, providing a wafer having a wafer thickness includes cutting or punching out the wafer from a sheet of liquid absorbent material. The sheet is preferably of a thickness that is sufficient to make contact with the liquid beverage when the wafer is secured to the beverage container. Preferably, however, the sheet thickness is greater than the recess thickness so that the wafer rests on the surface when the wafer is secured into the recess. Alternatively, the wafer material may be shredded and packed or blown into the recess to form a liquid absorbent substrate on the base of the container.

In one embodiment, providing a wafer having a wafer dimension includes forming the wafer so that the wafer fits into the recess. Preferably, the wafer dimension substantially approximates the recess dimension to maximize the surface area available for absorption.

Securing the wafer onto the outer portion of the container typically includes, in one embodiment, using an adhesive glue to secure the wafer onto the outer portion. Any adhesive glue sufficient for fastening the wafer onto the outer portion may be used in accordance with the present invention. Preferably, the adhesive should not degrade or interfere with the absorptive qualities of the wafer. Also, preferably the adhesive glue should not degrade the material from which the cup is comprised such that the liquid containing qualities of the cup are jeopardized.

In another embodiment of the invention, a one-piece integral design is provided for the beverage container and the wafer, or the base and the wafer, or any variation thereof. What is important is that the method of manufacturing the beverage container include producing a liquid absorbent portion on the cup, and preferably the base of the cup.

While the invention has been described by way of example and in terms of specific embodiments, it is to be understood that the invention is not limited to the disclosed embodiments. To the contrary, it is intended to cover various modifications and similar arrangements as would be apparent to one skilled in the art. For example, the wafer may be integrally formed as part of the container, e.g., cup base, during manufacture of the container. Therefore, the scope of the appended claims should be accorded the broadest interpretation so as to encompass all such modifications and similar arrangements.

I claim:

1. A liquid-absorbent wafer in combination with a liquid container having a base and an upstanding sidewall attached to the base, said base dividing the container into an inner portion forming a liquid containing vessel for liquids and an outer portion, the wafer comprising:

a top surface and a bottom surface, said top and bottom surfaces defining a wafer thickness and a wafer dimension;

wherein the top surface is secured to said base; and wherein the bottom surface is made of a liquid absorbent material that makes contact with liquid on a surface upon which the container rests and absorbs the liquid.

2. The wafer of claim 1, wherein the container further includes a recess formed between the outer portion of the base and the upstanding sidewall, wherein the wafer fits into the recess.

3. The wafer of claim 1, wherein the wafer has a substantially rectangular cross-section.

4. The wafer of claim 1, wherein the wafer has a substantially circular cross-section.

5. The wafer of claim 4, wherein the base is circular and the upstanding sidewall follows the base forming a substantially cylindrical container.

6. The wafer of claim 5, wherein the circular wafer is secured within a recess on the cylindrical container.

7. The wafer of claim 1, wherein the container further includes a lid removably attached to the upstanding sidewall, said lid having an upper surface for covering the container and making the beverage container substantially liquid impermeable.

8. The wafer of claim 7, wherein the lid further includes a beverage sipping groove formed on the upper surface of the lid for drinking liquid within the container.

9. The wafer of claim 3, wherein the base is rectangular and the upstanding sidewall follows the base forming a rectangular container.

10. The wafer of claim 9, wherein the rectangular container includes a top portion fashioned with the rectangular container to form a closed container.

11. The wafer of claim 10, wherein the top portion of the rectangular container has a straw hole for the insertion of a straw therein.

12. The wafer of claim 9, wherein the rectangular wafer is secured onto the outer portion of the base of the rectangular container.

13. The wafer of claim 1, wherein at least the bottom surface of the wafer is made of a sponge.

14. The wafer of claim 1, wherein at least the bottom surface of the wafer is made of a liquid-absorbent fibrous paper product.

15. The wafer of claim 1, wherein the wafer has at least one liquid absorbent portion that is contact with liquid on a surface.

16. The wafer of claim 1, wherein the wafer has substantially the same surface area as the base of the container.

17. The wafer of claim 1, wherein the wafer is secured to the container with an adhesive substance.

18. A liquid-absorbent wafer in combination with a beverage container, comprising:

a wafer dimension having a geometry;

a wafer thickness forming a liquid containing surface for absorbing and holding liquid;

a top portion that is secured onto the outer portion of the container; and a bottom portion that is made of a liquid absorbent material that makes contact with liquid on a surface upon which the container rests and absorbs the liquid.

19. The wafer of claim 18, wherein the wafer thickness is greater than or equal to a recess dimension formed in a base of the container, said base having an outer portion and inner portion formed by the base and an upstanding sidewall, wherein the container sits on the wafer when the wafer is secured into the recess.

20. The wafer of claim 18, wherein the wafer geometry is substantially circular such that the wafer has a wafer diameter and wafer circumference.

21. The wafer of claim 20, wherein the recess has a substantially circular cross section and a recess diameter such that the wafer circumference closely follows the recess diameter when the wafer is secured within the recess.

22. The wafer of claim 18, wherein the wafer geometry is substantially rectangular having a wafer length and a wafer width.

23. The wafer of claim 22, wherein the container is substantially rectangular in cross-sectional area across the base having a container base length and container base width such that the wafer length and wafer width is substantially equal to the container base length and container base width.

* * * * *